US009602946B2

(12) United States Patent
Karkkainen et al.

(10) Patent No.: US 9,602,946 B2
(45) Date of Patent: Mar. 21, 2017

(54) METHOD AND APPARATUS FOR PROVIDING VIRTUAL AUDIO REPRODUCTION

(71) Applicant: Nokia Technologies Oy, Espoo (FI)

(72) Inventors: Leo M. Karkkainen, Helsinki (FI); Akos Vetek, Helsinki (FI); Mikko A. Uusitalo, Helsinki (FI); Mikko J. Honkala, Espoo (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/578,218

(22) Filed: Dec. 19, 2014

(65) Prior Publication Data

US 2016/0183024 A1 Jun. 23, 2016

(51) Int. Cl.
*H04S 7/00* (2006.01)

(52) U.S. Cl.
CPC ..... *H04S 7/303* (2013.01)

(58) Field of Classification Search
CPC ..... H04S 7/303
See application file for complete search history.

(56) References Cited

U.S. PATENT DOCUMENTS 5,647,016 A * 7/1997 Takeyama ..... H04S 7/304 340/961
5,809,149 A * 9/1998 Cashion ..... H04S 1/005 381/17
6,097,315 A * 8/2000 Minter ..... G01S 3/784 340/691.2
6,782,104 B1 8/2004 Vieilledent
6,956,955 B1 * 10/2005 Brungart ..... H04S 7/30 381/17
7,649,444 B1 1/2010 Fear et al.
8,073,125 B2 12/2011 Zhang et al.
(Continued)

FOREIGN PATENT DOCUMENTS

EP 1 296 155 A1 3/2003
KR 2009/0090693 A 8/2009
(Continued)

OTHER PUBLICATIONS

Douglas S. Brungart, "Control of Perceived Distance in Virtual Audio Displays", Proceedings of the 20th Annual International Conference of the IEEE Engineering and Biology Society, vol. 20, No. 2, 1998, pp. 1101-1104.*
(Continued)

*Primary Examiner* — Brenda Bernardi
(74) *Attorney, Agent, or Firm* — Alston & Bird LLP

(57) ABSTRACT

A method, apparatus and computer program product are provided to permit audio signals to provide additional information to a user regarding the distance to the source of the audio signals, thereby increasing a user's situational awareness. In the context of a method, a distance and a direction from a user to an object are determined. The method also scales the distance to the object to create a modified distance within a predefined sound field region about the user. The method also causes an audio cue relating to the object to be audibly provided to the user. The audio cue is such that the object appears to be located within the predefined sound field region in the direction and at the modified distance from the user from the user.

20 Claims, 8 Drawing Sheets

(56) References Cited

U.S. PATENT DOCUMENTS

| | | | | |
|---|---|---|---|---|
| 8,509,454 | B2 | 8/2013 | Kirkeby et al. | |
| 8,682,679 | B2 * | 3/2014 | Breebaart | H04S 3/008 704/500 |
| 2010/0026780 | A1 | 2/2010 | Tico et al. | |
| 2010/0191537 | A1 | 7/2010 | Breebaart | |
| 2011/0164141 | A1 | 7/2011 | Tico et al. | |
| 2012/0128174 | A1 | 5/2012 | Tammi et al. | |
| 2012/0262536 | A1 | 10/2012 | Chen et al. | |
| 2012/0284619 | A1 | 11/2012 | Myllyla et al. | |
| 2013/0016842 | A1 | 1/2013 | Schultz-Amling et al. | |
| 2013/0044884 | A1 | 2/2013 | Tammi et al. | |
| 2013/0132845 | A1 | 5/2013 | Tammi et al. | |
| 2015/0296319 | A1 | 10/2015 | Shenoy et al. | |

FOREIGN PATENT DOCUMENTS

| | | | |
|---|---|---|---|
| WO | WO 2013/093187 | A2 | 6/2013 |
| WO | WO 2013/093565 | A1 | 6/2013 |
| WO | WO 2014/130221 | A1 | 8/2014 |

OTHER PUBLICATIONS

Douglas S. Brungart, "Near-Field Virtual Audio Displays", Presence, vol. 11, No. 1, Feb. 2002, pp. 93-106.*

Belloch, J. A. et al., *Headphone-based spatial sound with a GPU accelerator*, Elsevier, Procedia Computer Science vol. 9 (2012) 116-125.

*Binaudios by Dominic Wilcox Encourage Users to "listen to the City"* [online][retrieved Feb. 22, 2016]. Retrieved from the Internet: <URL: http://www.dezeen.com/2014/05/28/binaudios-by-dominic-wilcox-allow-users-to- listen-to-the-city/>. (dated May 28, 2014) 6 pages.

*Coincidence rangefinder—Wikipedia, the free encyclopedia* [online][retrieved Feb. 22, 2016]. Retrieved from the Internet: <URL: https://en.wikipedia.org/wiki/Coincidence_rangefinder>. (Dec. 21, 2015) 5 pages.

*HRTF implementation in matlab—Signal Processing Stack Exchange* [online][retrieved Feb. 22, 2016]. Retrieved from the Internet: <URL: http://dsp.stackexchange.com/questions/12771/hrtf-implementation-in-matlab>. (Nov. 2013) 1 page.

*HRTF-Based Systems—CIPIC International Laboratory* [online][retrieved Dec. 11, 2014] Retrieved from the Internet: <URL: http://interface.cipic.ucdavis.edu/sound/tutorial/hrtfsys.html>. (Feb. 25, 2011) 8 pages.

*Intelligent Headset—The worlds first Intelligent headset* [online][retrieved Feb. 22, 2016]. Retrieved from the Internet: <URL: https://intelligentheadset.com/>. (2013) 4 pages.

Kärlläinen, A. et al., *Practical Procedure for Large Scale Personalized Head Related Transfer Function Acquisition*, Audio Engineering Society Conference: 51st International Conference (Aug. 2013) 87-94.

*LG—Life's Good* [online][retrieved Feb. 22, 2016]. Retrieved via the Internet Archive Wayback Machine at https://web.archive.org/web/20140823131048/http://www.lg.com/global/g2/sub1.html (2013) 6 pages.

*Oculus Rift Developer Kit 2 and Latency Mitigation techniques* [online][retrieved Feb. 22, 2016] Retrieved from the Internet: <URL: http://www.slideshare.net/casseveritt/dk2-latmithpg2014cass>. (Jul. 9, 2014) 12 pages.

*Quuppa—Do More With Location* [online][retrieved Feb. 22, 2016]. Retrieved from the Internet: <URL:http://quuppa.com/>. 2 pages.

*Spynet Bone Directional Audio Binoculars—isme.com* [online][retrieved Oct. 31, 2014]. Retrieved from the Internet: <URL: http://www.isme.com/spynet-bone-directional-audio-binoculars/1437327092.prd>. 2 pages.

International Search Report and Written Opinion for Application No. PCT/FI2015/050874 dated Apr. 19, 2016.

Brungart, D. et al., *Auditory Localization of Nearby Sources in a Virtual Audio Display*, IEEE Workshop on Applications of Signal Processing to Audio and Acoustics (Oct. 2001) 107-110.

Billinghurst, M. et al., *An Evaluation of Wearable Information Spaces*, IEEE Virtual Reality Annual International Symposium (Mar. 1998) 20-27.

* cited by examiner

METHOD AND APPARATUS FOR PROVIDING VIRTUAL AUDIO REPRODUCTION

TECHNOLOGICAL FIELD

A method, apparatus and computer program product are provided in accordance with an example embodiment in order to cause at least one audio cue relating to an object to be provided and, more particularly, to cause at least one audio cue to be provided such that the object appears to be located at a normalized distance within a predefined sound field region about a user.

BACKGROUND

Audio signals may provide information to a user regarding the source of the audio signals, both in terms of the direction from which the audio signals appear to originate and the distance at which the audio signals appear to originate. In an effort to facilitate the identification of the direction and distance to the source of the audio signals, the dominant sound source(s) that contribute to the audio signals may be identified and ambient noise may be extracted. As a result, a greater percentage of the audio signals that are heard by the user emanate from the dominant sound source(s).

In order to enhance the information provided by the audio signals regarding the distance to the source of the audio signals, the gain of the audio signals may be modified. For example, the audio signals that originate from a source closer to the user may be increased in volume, while the audio signals that originate from objects that are further away from the user are attenuated. Additionally, the diffusivity of the audio signals may be modified to enhance the information provided by the audio signals regarding the distance to the source of the audio signals. For example, audio signals that originate from sources that are closer to the user may be reproduced in a manner that is less diffuse, while audio signals that originate from sources further from the user may be reproduced with greater diffusivity.

However, humans are generally only capable of perceiving differences in the distances of the sound sources of audio signals at a range of a couple of meters with a human's accuracy in detecting differences in the distances of the sound sources of audio signals at greater distances quickly deteriorating. Thus, even if the gain and diffusivity of the audio signals are modified based upon the distance of the source of the audio signals to the user, humans may still struggle to distinguish the distances from which audio signals are generated by sources at different distances from the user once the sources are more than a couple of meters from the user. Consequently, audio signals may effectively provide information regarding the direction to the sound sources of the audio signals, but may be limited in the information recognized by humans with respect to the distance to the sound source of the audio signals, thereby limiting the user's sense of their surroundings.

BRIEF SUMMARY

A method, apparatus and computer program product are provided in accordance with an example embodiment to permit audio signals to provide additional information to a user regarding the distance to the source of the audio signals, thereby increasing a user's situational awareness. In this regard, the method, apparatus and computer program product of an example embodiment are configured to modify the audio signals in a manner that permits a user to more readily distinguish between sources of audio signals at different distances from the user, even in instances in which the sources of the audio signals are further away from the user, such as by being located more than a couple of meters from the user. The method, apparatus and computer program product of an example embodiment are configured to cause audio cues to be provided that are either based upon the audio signals generated by a sound source or an artificially created sound. In either instance, a user obtains additional information from the audio signals regarding the distance to the source of the audio signals such that the user has greater situational awareness.

In an example embodiment, a method is provided that includes determining a distance and a direction from a user to an object. The method of this example embodiment also scales the distance to the object to create a modified distance within a predefined sound field region about the user. The method of this example embodiment also causes an audio cue relating to the object to be audibly provided to the user. The audio cue is such that the object appears to be located within the predefined sound field region in the direction and at the modified distance from the user.

In an example embodiment, the object is a sound source. The method of this example embodiment also includes receiving audio signals from the sound source with the at least one audio cue being caused to be audibly provided by causing a representation of the audio signals from the sound source to be audibly provided to the user such that the audio signals appear to originate at the modified distance and from the direction of the sound source. In an alternative embodiment, the method causes the at least one audio cue to be audibly provided to the user by causing an artificially created sound representative of the object to be audibly provided to the user. The method of an example embodiment causes at least one audio cue to be audibly provided to the user by processing audio signals with a head-related transfer function filter to create the at least one audio cue. The head-related transfer function filter is dependent upon both the modified distance and the direction from the user to the object. The method of an example embodiment also determines a position and a head bearing of the user and identifies the head related transfer function filter based upon the position and head bearing of the user. In this regard, the method determines a distance and a direction from a user to an object by determining the distance and the direction from the user to the object based upon the position and head bearing of the user.

In an example embodiment, the predefined sound field region includes a volume about the user of a predefined dimension. In this example embodiment, the method scales the distance to the object to create the modified distance by scaling coordinates representative of the object so as to lie within the volume of the predefined dimension. The volume of the predefined dimension may be, for example, a sphere of a predefined radius with the method of this example embodiment scaling coordinates representative of the object by scaling spherical coordinates representative of the object so as to lie within the sphere of the predefined radius.

In another example embodiment, an apparatus is provided that includes at least one processor and at least one memory including computer program code with the at least one memory and a computer program code configured to, with the processor, cause the apparatus to at least determine a distance and a direction from a user to an object. The at least one memory and the computer program code are also configured to, with the processor, cause the apparatus of the example embodiment to scale the distance to the object to create a modified distance within a predefined sound field region about the user. The at least one memory and the computer program code are further configured to, with the processor, cause the apparatus of the example embodiment to cause at least one audio cue relating to the object to be audibly provided to the user such that the object appears to be located within the predefined sound field region in the direction and at the modified distance from the user.

In an embodiment in which the object includes a sound source, the at least one memory and the computer program code are further configured to, with the processor, cause the apparatus to receive audio signals from the sound source and to cause at least one audio cue to be audibly provided to the user by causing a representation of the audio signals from the sound source to be provided such that the audio signals appear to originate at the modified distance and from the direction of the sound source. In an alternative embodiment, the at least one memory and the computer program code are configured to, with the processor, cause the apparatus to cause at least one audio cue to be audibly provided to the user by causing an artificially created sound representative of the object to be audibly provided to the user.

The at least one memory and the computer program code are configured to, with the processor, cause the apparatus of an example embodiment to cause at least one audio cue to be audibly provided to the user by processing audio signals with the head-related transfer function filter to create the at least one audio cue. The head-related transfer function filter is dependent upon both the modified distance and the direction from the user to the object. In an example embodiment, the at least one memory and computer program code are further configured to, with the processor, cause the apparatus to determine a position and a head bearing of the user and identify the head related transfer function filter based upon the position and head bearing of the user. In this regard, the at least one memory and computer program code are configured to, with the processor, cause the apparatus to determine a distance and a direction from a user to an object by determining the distance and the direction from the user to the object based upon the position and head bearing of the user. In an example embodiment in which the predefined sound field region includes a volume about the user of a predefined dimension, the at least one memory and the computer program code are configured to, with the processor, cause the apparatus to scale the distance to the object to create a modified distance by scaling coordinates representative of the object so as to lie within the volume of the predefined dimension. The volume of an example embodiment may be a sphere of a predefined radius with the at least one memory and the computer program code being configured to, with the processor, cause the apparatus to scale coordinates representative of the object by scaling spherical coordinates representative of the object so as to lie within the sphere of the predefined radius.

In a further example embodiment, a computer program product including at least one non-transitory computer-readable storage medium having computer-executable program code portions stored therein is provided with the computer-executable program code portions including program code instructions configured to determine a distance and a direction from a user to an object. The computer-executable program code portions of this example embodiment also include program code instructions configured to scale the distance to the object to create a modified distance within a predefined sound field region about the user. The computer-executable program code portions of this example embodiment further include program code instructions configured to cause at least one audio cue relating to the object to be audibly provided to the user such that the object appears to be located within the predefined sound field in the direction and at the modified distance from the user.

In an embodiment in which the object includes a sound source, the computer-executable program code portions further include program instructions configured to receive audio signals from the sound source. In this example embodiment, the program code instructions configured to cause at least one audio cue to be audibly provided to the user include program code instructions configured to cause a representation of the audio signals from the sound source to be audibly provided to the user such that the audio signals appear to originate at the modified distance and from the direction of the sound source. In an alternative embodiment, the program code instructions configured to cause at least one audio cue to be audibly provided include program code instructions configured to cause an artificially created sound representative of the object to be audibly provided to the user.

In an example embodiment, the program code instructions configured to cause at least one audio cue to be audibly provided to the user include program code instructions configured to process audio signals with a head-related transfer function filter to create the at least one audio cue. The head-related transfer function filter is dependent upon both the normalized distance and the direction from the user to the object. In an example embodiment, the computer-executable program code portions further include program code instructions configured to determine a position and a head bearing of the user and identify the head related transfer function filter based upon the position and head bearing of the user. In this regard, the program code instructions configured to determine a distance and a direction from a user to an object include program code instructions configured to determine the distance and the direction from the user to the object based upon the position and head bearing of the user. In an embodiment in which the predefined sound field region includes a volume about the user of a predefined dimension, the program code instructions configured to scale the distance to the object to create a modified distance include program code instructions configured to scale coordinates representative of the object so as to lie within the volume of the predefined dimension.

In yet another example embodiment, an apparatus is provided that includes means for determining a distance and a direction from a user to an object. The apparatus of this example embodiment also includes means for scaling the distance to the object to create a modified distance within a predefined sound field region about the user. In this example embodiment, the apparatus further includes means for causing at least one audio cue relating to the object to be audibly provided to the user such that the object appears to be located within the predefined sound field in the direction and at the modified distance from the user.

BRIEF DESCRIPTION OF THE DRAWINGS

Figure 1:
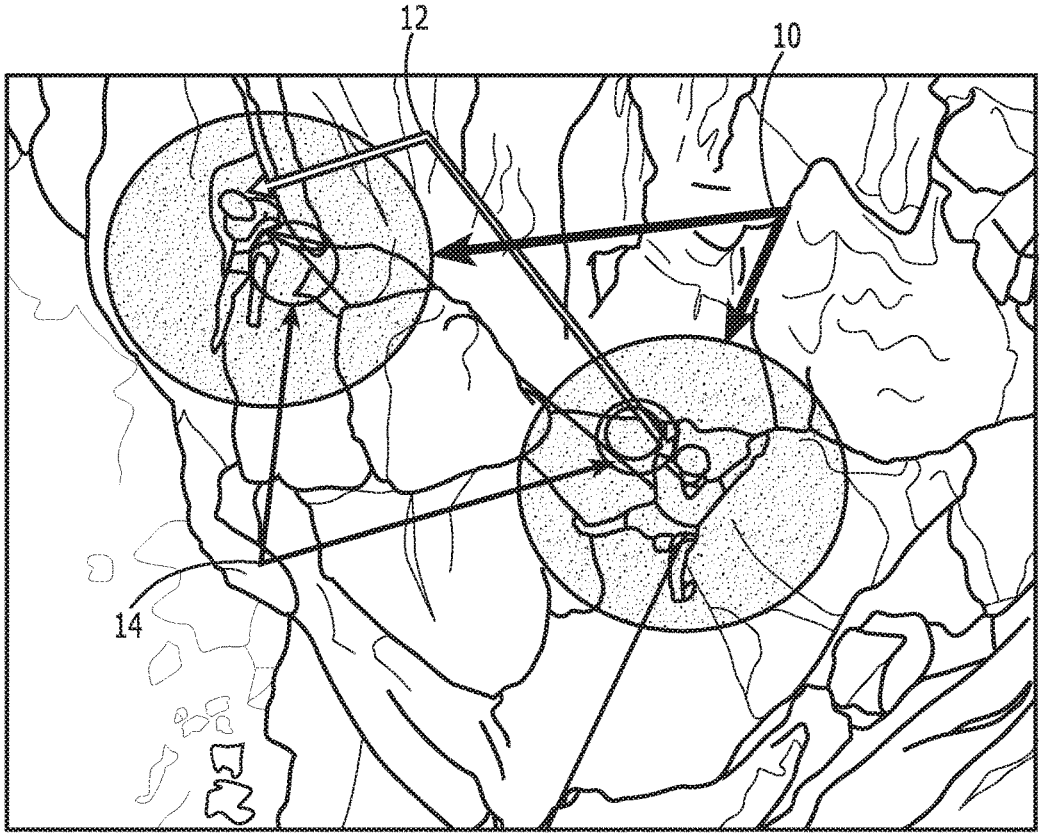
Figure 2:
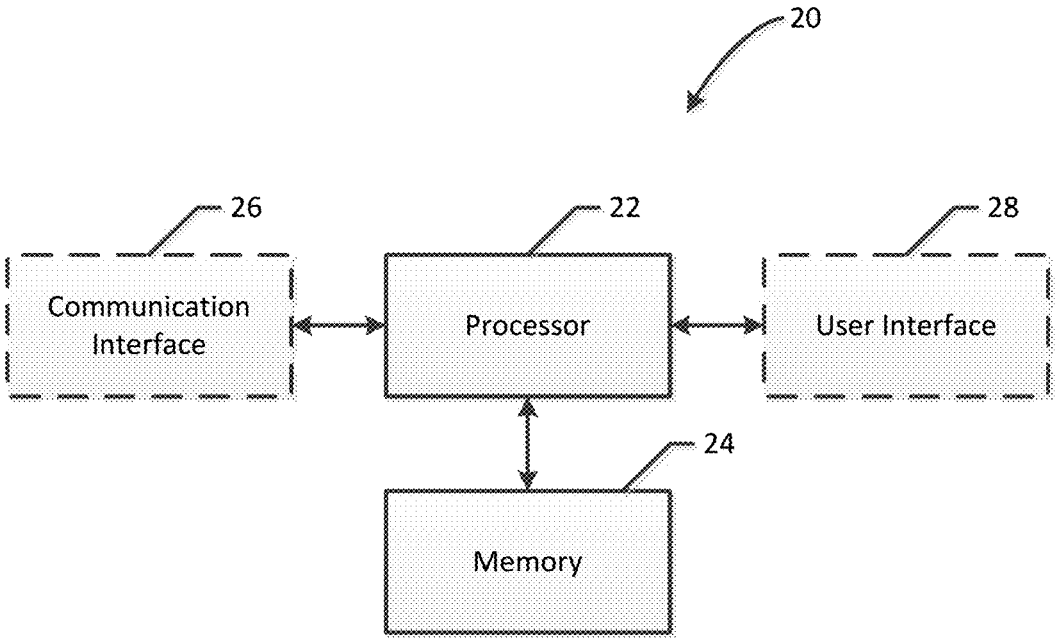
Figure 3:
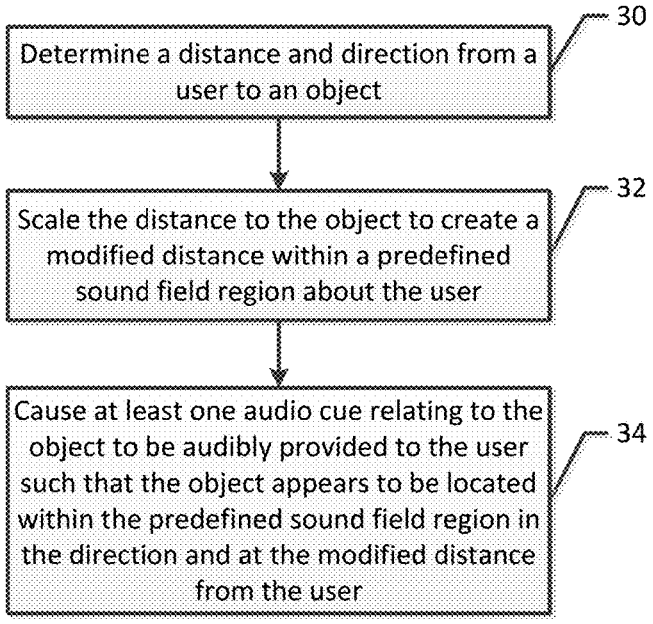
Figure 4:
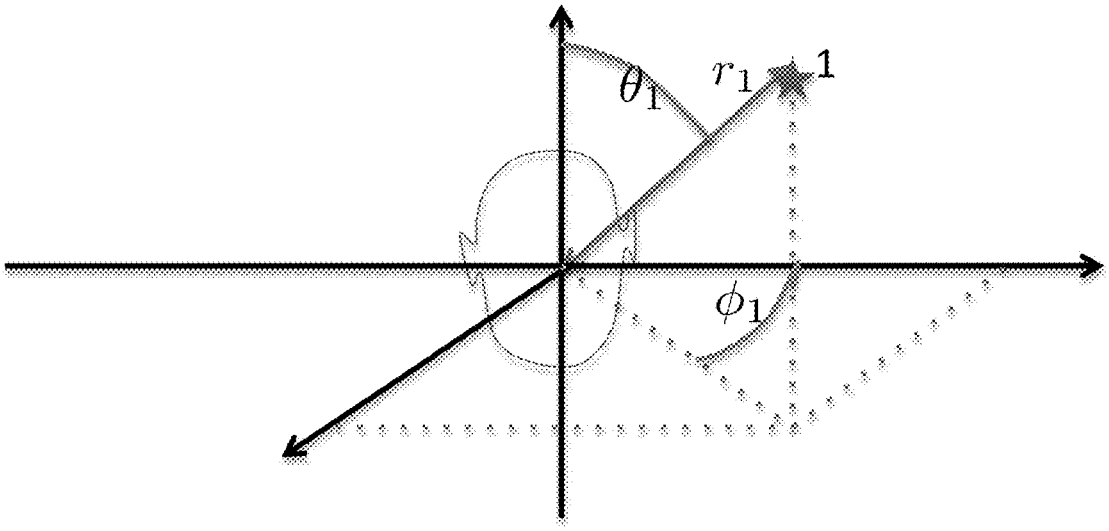
Figures 5A, 5B, 5C:
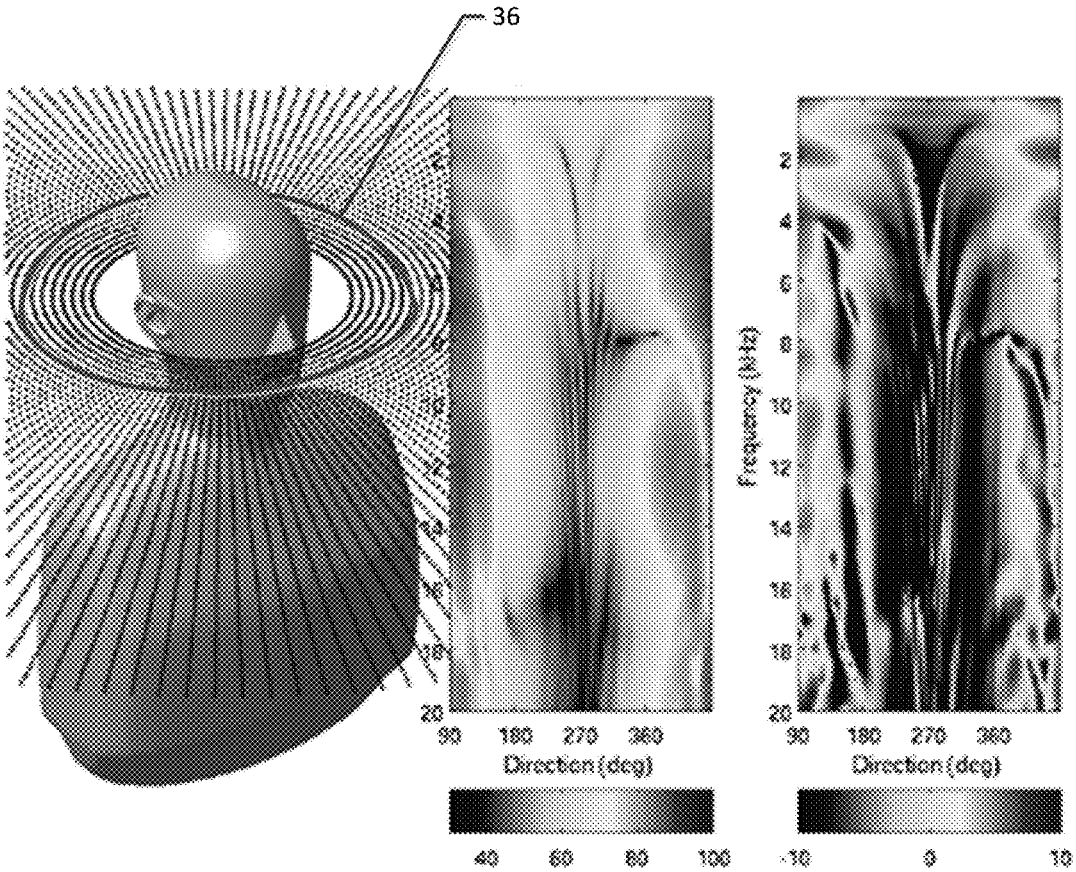
Figure 6:
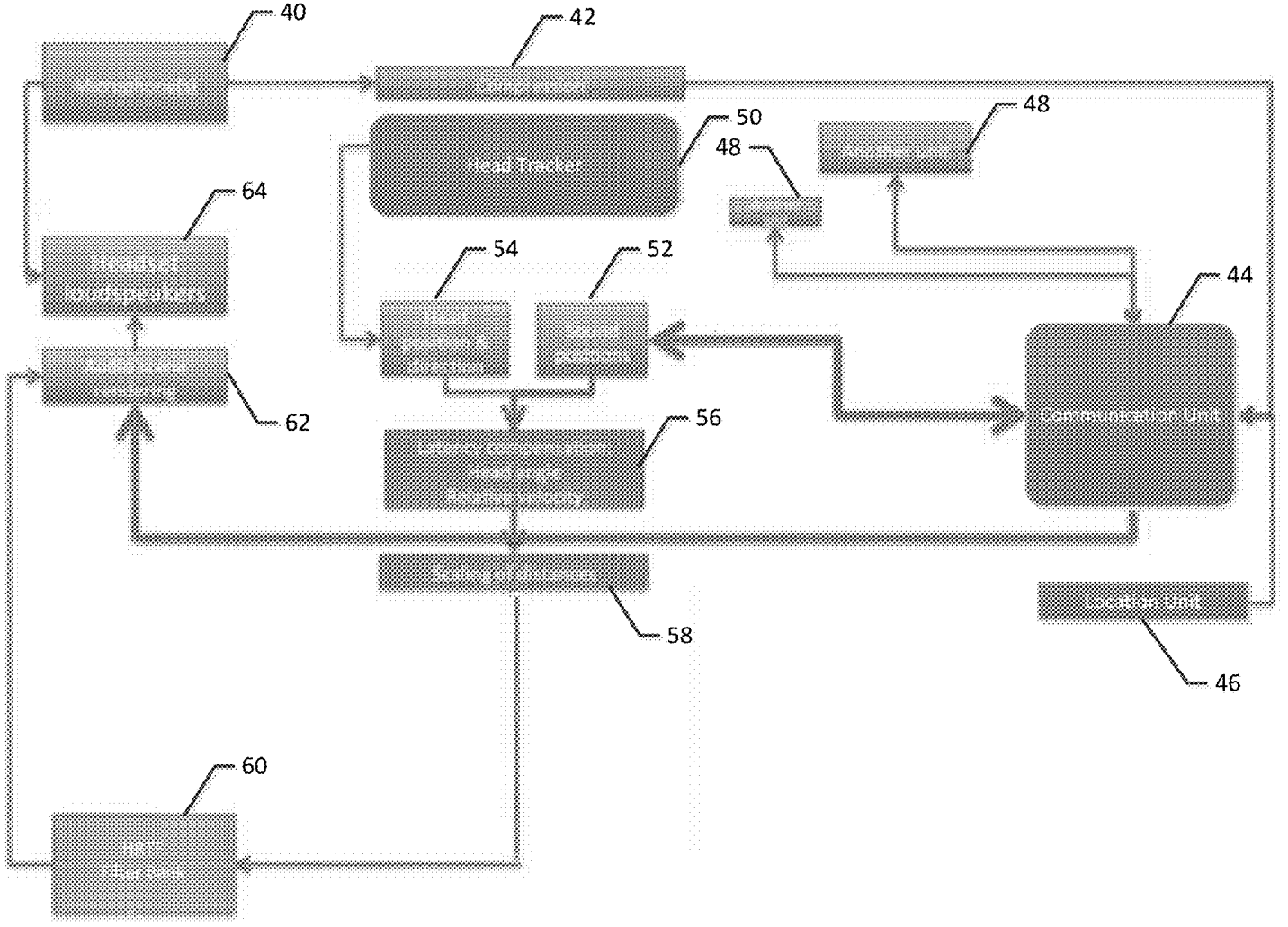
Figure 7:
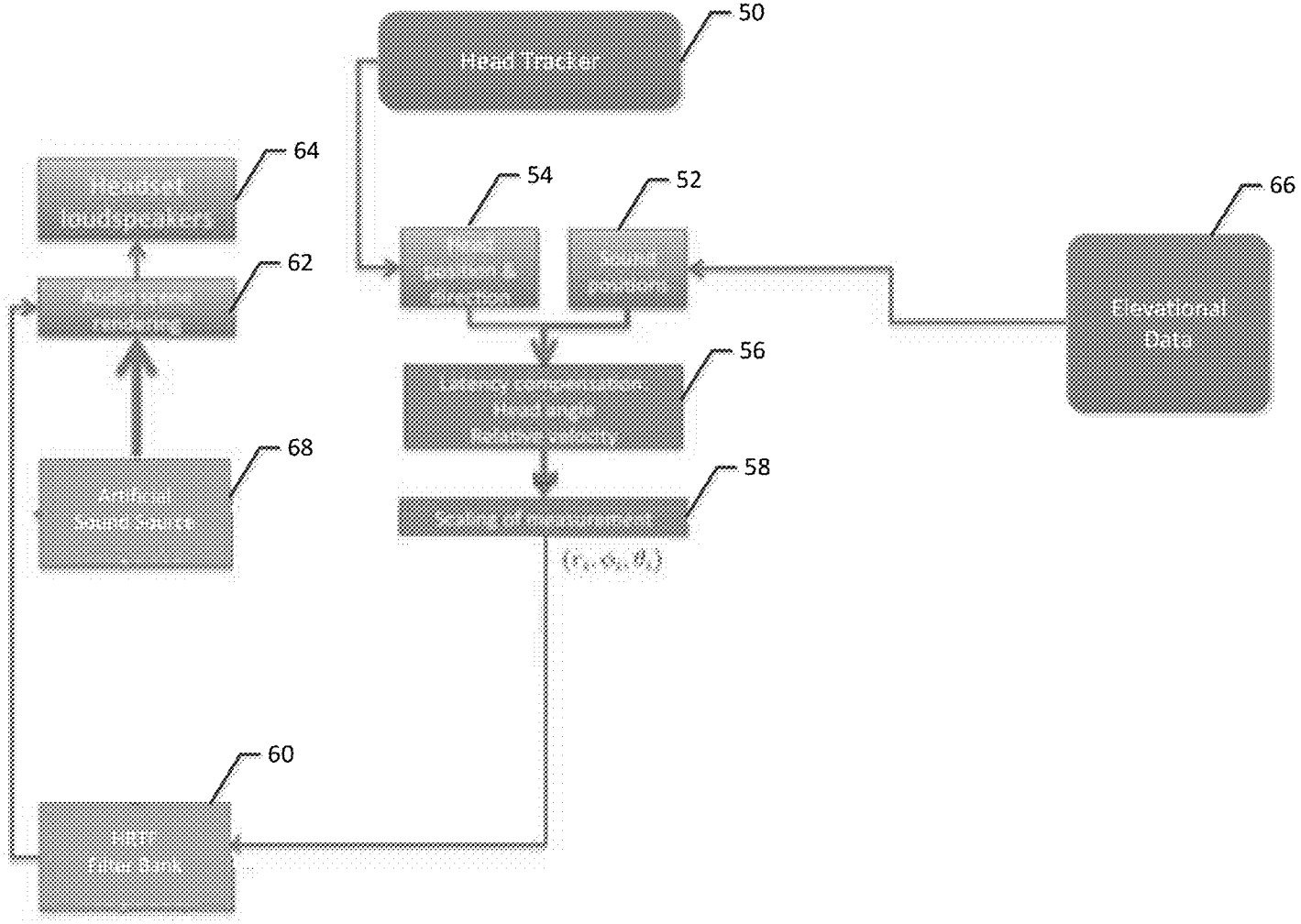
Figure 8:
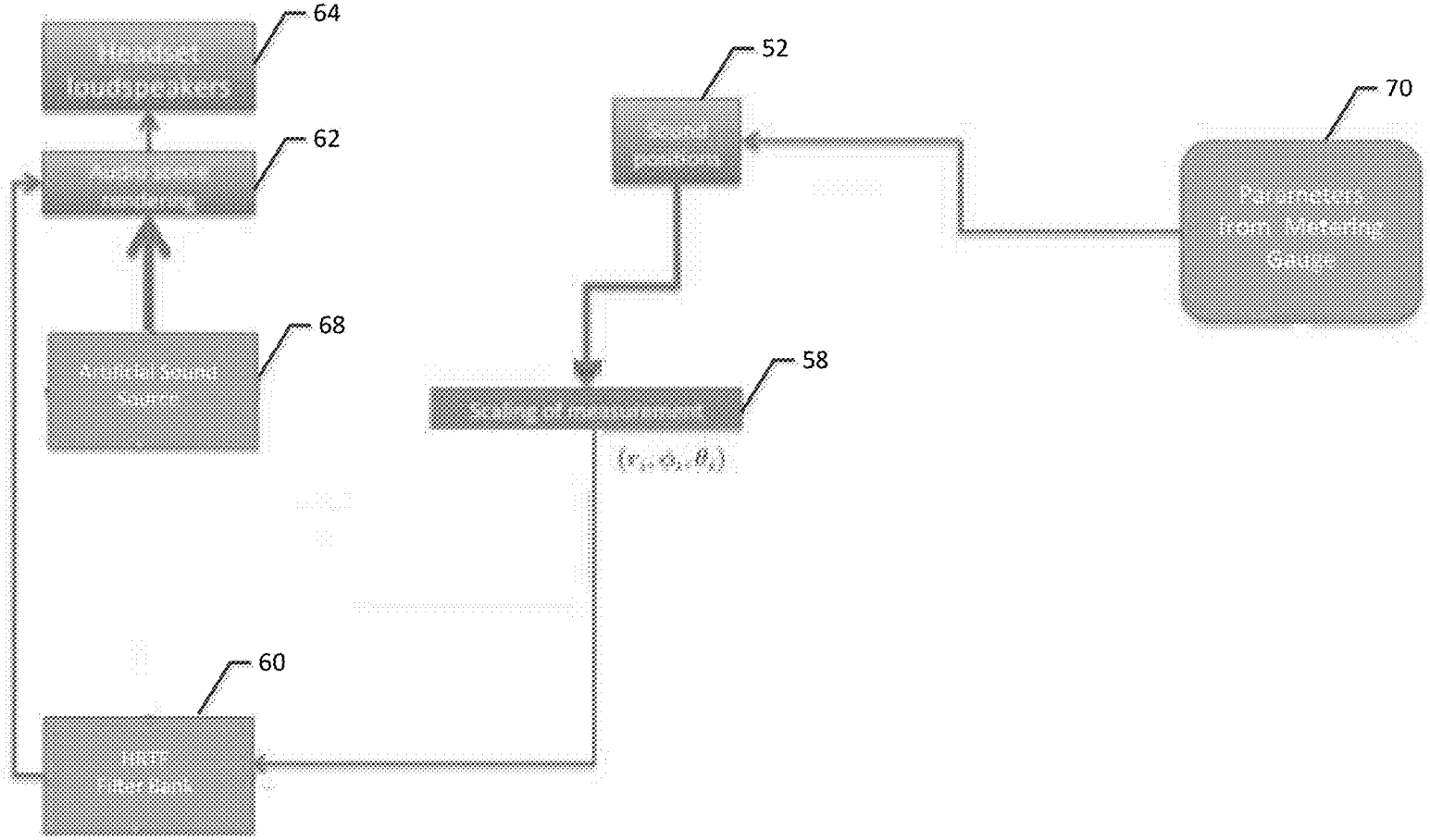

Having thus described certain example embodiments of the present invention in general terms, reference will hereinafter be made to the accompanying drawings which are not necessarily drawn to scale, and wherein:

FIG. 1 is a perspective view of a pair of climbers that could benefit from audio cues that provide additional information regarding the distance from one climber to another in accordance with an example embodiment of the present invention;

FIG. 2 is block diagram of an apparatus that may be specifically configured in accordance with an example embodiment of the present invention;

FIG. 3 is a flowchart illustrating operations performed, such as by the apparatus of FIG. 2, in accordance with an example embodiment of the present invention;

FIG. 4 is a graphical representation of the spherical coordinates within a sphere of predefined radius about a user;

FIG. 5*a* is a perspective view of a plurality of points about a user at which head-related transfer functions are defined;

FIG. 5*b* is a graphical representation of the near-field results of the head-related transfer function filter of FIG. 5*a* taken at a distance of 20 centimeters;

FIG. 5*c* is graphical representation of the amplitude of the near-field head-related transfer function to the far-field head-related transfer function;

FIG. 6 is a block diagram of operations performed in accordance with an example embodiment in which audio signals are received from a sound source in accordance with an example embodiment of the present invention;

FIG. 7 is a block diagram of operations performed in accordance with an example embodiment in which artificially created sounds representative of the height above an object are provided to user in accordance with an example embodiment of the present invention; and FIG. 8 is a block diagram in which artificially created sounds representative of a parameter measured by a metering gauge are provided to a user in accordance with an example embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a physical storage medium (e.g., volatile or non-volatile memory device), may be differentiated from a "computer-readable transmission medium," which refers to an electromagnetic signal.

A method, apparatus and computer program product are provided in accordance with an example embodiment in order to provide audio cues to a user that provide additional information regarding the distance of an object, such as a sound source, relative to the user. Thus, a user may not only determine the direction to the object, but also the distance, at least in relative terms, to the object. Thus, a user may be more aware of their spatial surroundings and have greater situational awareness by being able to discriminate between different objects based upon the distance to the objects as determined from the audio signal. As described below, the method, apparatus and computer program product of an example embodiment may be utilized both in conjunction with objects, such as sound sources, that generate audio signals that are heard by the user as well as objects that do not generate audio signals, but for which artificially created sounds may be generated that convey information to the user based upon the relative distance from which the artificially created sounds appear to originate. In either instance, the user is able to glean additional information from the audio cues so as to be more fully informed regarding their surroundings.

By way of example, but not of limitation, FIG. 1 depicts a scenario in which two climbers are separately scaling different faces of a rocky outcrop. The climbers are separated from one another by a sufficient distance that even if a first climber hears the sounds generated by a second climber, the first climber may be able to determine the direction to the second climber, but may not be able to determine the distance to the second climber, at least not with any accuracy. In this regard, humans are able to distinguish differences in the distance to various sound sources within a predefined sound field region thereabout, such as within a spherical volume having a radius of about two meters. In instance in which a sound source is spaced further away, such as more than two meters from the listener, the listener may have difficulty determining with any accuracy the distance to the sound source even though the listener may hear the audio signals generated by the sound source and be able to identify the direction to the sound source. As such, in the scenario depicted in FIG. 1, the climbers are separated from one another by more than two meters such that each climber has difficulty determining the distance to the other climber from the sounds generated by other climber. By way of visual representation, a region 10 about each climber within which the respective climber can identify differences in the distance from a sound source to the climber is depicted with each climber being outside of the region within which the other climber can distinguish differences in the distances to various sound sources. Thus, each climber has more limited situational awareness, at least in terms of the distance to the other climber based upon the sounds from the other climber, than may be desired.

In order to facilitate increased situational awareness including an enhanced ability to identify a distance to an object, such as a source of audio signals, an apparatus 20 is provided in accordance with an example embodiment that causes audio cues to be provided from which a listener may obtain not only directional information regarding an object, such as a sound source, but also more accurate distance information, at least in relative terms, regarding the distance to the object, such as the sound source. The apparatus may be embodied in various manners including by being embodied by various types of computing devices, such as a mobile terminal including, for example, a mobile telephone, a smartphone, a tablet computer, a personal digital assistant (PDA) or the like, as well as computing devices embodied by headsets 12 worn by a user as shown in FIG. 1 and other types of audio playback and audio communication devices. As the foregoing examples illustrate, the apparatus may be embodied either by a device, such as a stereo headset, that is configured to render the audio signals for the user or by a computing device that is configured to process the audio signals and to then provide the processed signals to another audio playback device that is configured to render the audio signals for the user. The headsets or other audio playback and audio communication devices of an example embodiment include at least two channels, one for each ear.

Regardless of the manner in which the apparatus 20 is embodied, the apparatus of an example embodiment is depicted in FIG. 2 and includes, is associated with or otherwise is in communication with a processor 22, a memory device 24, a communication interface 26 and user interface 28. In some embodiments, the processor (and/or co-processors or any other processing circuitry assisting or otherwise associated with the processor) may be in communication with the memory device via a bus for passing information among components of the apparatus. The memory device may be non-transitory and may include, for example, one or more volatile and/or non-volatile memories. In other words, for example, the memory device may be an electronic storage device (for example, a computer readable storage medium) comprising gates configured to store data (for example, bits) that may be retrievable by a machine (for example, a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

As noted above, the apparatus 20 may be embodied by a computing device, such as a pair of headsets 12. However, in some embodiments, the apparatus may be embodied as a chip or chip set. In other words, the apparatus may comprise one or more physical packages (for example, chips) including materials, components and/or wires on a structural assembly (for example, a circuit board). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 22 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 22 may be configured to execute instructions stored in the memory device 24 or otherwise accessible to the processor. Alternatively or additionally, the processor may be configured to execute hard coded functionality. As such, whether configured by hardware or software methods, or by a combination thereof, the processor may represent an entity (for example, physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (for example, the computing device) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

The apparatus 20 of an example embodiment may also include a communication interface 26 that may be any means such as a device or circuitry embodied in either hardware or a combination of hardware and software that is configured to receive and/or transmit data from/to other electronic devices in communication with the apparatus, such as by being configured to receive data from an in-vehicle global positioning system (GPS), in-vehicle navigation system, a personal navigation device (PND), a portable navigation device or other in-vehicle data collection system. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication.

The apparatus 20 of an example embodiment may also include or otherwise be in communication with a user interface 28. The user interface may include speakers or the like for providing output to the user. In some embodiments, the user interface may also include a touch screen display, a keyboard, a mouse, a joystick or other input/output mechanisms. In this example embodiment, the processor 22 may comprise user interface circuitry configured to control at least some functions of one or more input/output mechanisms and/or to receive the user input provided via the input mechanisms, such as the rotatable dial wheel. The processor and/or user interface circuitry comprising the processor may be configured to control one or more functions of one or more input/output mechanisms through computer program instructions (for example, software and/or firmware) stored on a memory accessible to the processor (for example, memory device 14, and/or the like).

Referring now to FIG. 3, the operations performed, such as by the apparatus 20 of FIG. 2, in accordance with an example embodiment are depicted so as to cause at least one audio cue to be provided to a user such that an object, such as a sound source, appears to be located at a normalized distance from the user with the normalized distance being a scaled representation of the actual distance to the object. As shown in block 30, the apparatus of an example embodiment includes means, such as the processor 22 or the like, for determining a distance and a direction from a user to an object. In an example embodiment, such as depicted in FIG. 1, the object may be a sound source that generates audio signal. In this embodiment, the sound source is located at a distance and in a direction relative to the user, such as the person wearing the headsets 12 that embody the apparatus of an example embodiment of the present invention. Alternatively, the object may not generate audio signals itself, but information regarding the object, such as a parameter associated with the object, may be translated into and represented by a distance of the object from the user.

Regardless of the type of object, the apparatus 20, such as the processor 22, may be configured to determine the direction from the user to the object. For example, the apparatus, such as the processor, may be configured to determine the direction from the user to the object in any of a variety of different manners including those described by PCT Patent Application Publication No. W0 2013/093565 and US Patent Application Publication Nos. US 2012/0128174, US 2013/0044884 and US 2013/0132845.

Regarding the distance to the object, the apparatus 20, such as the processor 22, of an example embodiment is configured to determine the position of the user. The position of the user may be determined in various manners. For example, the apparatus may include or otherwise be in communication with a global positioning system (GPS) or other position tracking system that tracks the position of the user and provides information regarding the position of the user, such as the coordinate location of the user. In order to determine the distance to the object, the apparatus, such as the processor, is also configured to determine the location of the object, at least in relative terms with respect to other objects. In an embodiment in which the object is a sound source that provides audio signals, the apparatus, such as the processor, of an example embodiment is configured to determine the location of the sound source based upon information provided by a location unit, such as a GPS, associated with the sound source. Alternatively, the apparatus, such as the processor, may be configured to determine the location of the sound source by analyzing Bluetooth Low Energy (BTLE) received signal strength to determine the distance to the sound source, by analyzing a received signal strength indicator (RSSI) or by relying upon a locating system, such as provided by Quuppa Oy. Once the location of the object has been identified, the apparatus, such as the processor, is configured to determine the distance to the object based upon the difference in the respective locations of the object and the user.

Alternatively, as described below, in an instance in which the object does not generate audio signals, the apparatus 20, such as the processor 22, of an example embodiment is configured to receive information regarding one or more parameters associated with the object and to then determine the distance to the object based upon the one or more parameters associated with the object, such as by translating the one or more parameter values into respective distance values. In this regard, the one or more parameters associated with the object may be mapped to or otherwise associated with a respective distance to the object. For example, the distance to the object may vary directly or indirectly with respect to one or more parameters associated with the object. Additionally or alternatively, the distance may vary proportionately or disproportionately relative to the one or more parameters associated with the object. In an example embodiment, however, the distance of an object for which artificially created sound is generated is configured to vary in a direct and proportionate manner to a parameter associated with the object.

As shown in block 32 of FIG. 3, the apparatus 20 also includes means, such as the processor 22 or the like, for scaling the distance to the object to create a modified distance within a predefined sound field region about the user. In this regard, the distance to the object is scaled such that relative differences in the distances from the objects to the user are maintained. The predefined sound field region of an example embodiment is a volume about the user of a predefined dimension. As such, the apparatus, such as the processor, of this example embodiment is configured to scale the distance to the object to create a modified distance, such as a normalized distance, by scaling coordinates defining the location of the object so as to lie within the volume of the predefined dimension. As noted above, a human is generally only capable of discriminating between sound sources based upon the distance to the sound source for sound sources within a predefined sound field region about the listener, such as a sphere of about two meters in radius, and may be much less capable of distinguishing between sound sources based upon the distance to the sound source for sound sources that are located beyond this sphere of two meters from the listener. Thus, the volume about the user within which the distance to the object is scaled may be a sphere of a predefined radius, such as a sphere having a radius of two meters as shown by region 14 in FIG. 1. The apparatus, such as the processor, of this example embodiment is therefore configured to scale coordinates representing the object by scaling spherical coordinates representing the location of the object so as to lie within the sphere of the predefined radius. An example of the spherical coordinates ($r_1$, $\theta_1$, $\varnothing_1$) of a location designated 1 is depicted in FIG. 4.

The coordinates representative of the object are scaled, however, such that the relative differences in distance from various objects to the user are maintained. As such, the modified distance will be hereinafter described as a normalized distance as the distance to the various objects is normalized based upon predefined sound field region about the user. Thus, within a particular audio scene, the sound source that is furthest from the user is scaled such that the normalized distance to the sound source is at or near the periphery of the predefined sound field region, such as by being scaled so as to be at a normalized distance of two meters from the user. The other sound sources within the same audio scene may then be scaled by the apparatus 20, such as the processor 22, so as to be at other normalized distances within the same predefined sound field region about the user. In this regard, the distances to the other sound sources may be scaled based upon the distances to the other sound sources relative to the distance to the sound source that is furthest from the user.

By way of example in which the predefined sound field region about the user is sphere of a radius of two meters and in which a first sound source from the audio scene that is furthest from the user is scaled as to be at a normalized distance of two meters from user, a second sound source that is half the distance to the user relative to the first sound source may be scaled so as to be at a normalized distance of one meter from the user. Similarly, a third sound source that is at a distance of one-quarter the distance to the user relative to the first sound source maybe scaled so as to be at a normalized distance of a 0.5 meters from the user. Still further, a fourth sound source that is at distance that is 75% of the distance that the first sound source is located relative to the user may be scaled so as to be at a normalized distance of 1.5 meters from the user. Thus, the apparatus 20, such as the processor 22, is configured to scale the distances to the various objects within an audio scene to create normalized distances, such as by normalizing the distances relative to the distance of the sound source that is furthest from the user within the audio scene such that the normalized distances to all of the sound sources are within the predefined sound field region about the user within which the user can more readily distinguish between the distances to the respective sound sources.

In an embodiment in which the object does not produce audio signals and the distance to the object is a representation of a parameter associated with the object, the apparatus 20, such as the processor 22, is also configured to scale distance associated with the object to create a normalized distance within a predefined sound field region about the user. As described above with respect to sound sources, the distance to the object is scaled such that relative differences in the distances from the objects to the user (and, thus, the relative differences in the parameters associated with the objects) are maintained.

As shown in block 34 of FIG. 3, the apparatus 20 of an example embodiment also includes means, such as the processor 22, the user interface 28 or the like, for causing at least one audio cue relating to the object to be audibly provided to the user. The audio cue is audibly provided such that the object appears to be located within the predefined sound field region at the normalized distance from the user. In addition, the same or a different audio cue is audibly provided such that the object appears to be located in a respective direction from the user, that is, in the same direction in which the object is physically located relative to the user. Thus, the directionality information is maintained and the distance information is scaled such that the at least one audio cue causes the object to appear to be located at the normalized distance from the user, which is a distance within the predefined sound field region within which the user is able to more readily distinguish between sound sources that are located at different distances from the user.

In an instance in which the object is a sound source, the apparatus 20 of an example embodiment includes means, such as the user interface 28, communication interface 26, processor 22 or the like, for receiving audio signals from sound source. In this example embodiment, the apparatus, such as the processor, the user interface or the like, may be configured to cause the audio cue to be audibly provided by causing a representation of the same audio signals from the sound source to be provided to the user following processing of the audio signals such that the sound source appears to be located at the normalized distance from the sound source. Thus, the user, via the headsets 12, receives a representation of the same audio signals, although the distance at which the sound source appears to be located relative to the user has been scaled as described above. In the example depicted in FIG. 1, the sounds generated by a first climber may be processed such that the distance at which the first climber appears to be located is scaled so as to create a normalized distance within a sphere 14 of predefined radius, such as two meters, about the second climber. Thus, the second climber who hears the audio cue in the form of a modified representation of the sounds generated by the first climber can more readily distinguish between differences in the distance from which the sounds appear to originate. Thus, as the first climber goes further away or comes closer to the second climber, the second climber is better able to discern the relative distance to the first climber based upon the normalized distance within the sphere of the predefined radius about the second climber, thereby increasing the situational awareness of the second climber.

In an embodiment in which the object does not generate audio signals and in which the distance to the object represents the value of a parameter associated with the object, the apparatus 20, such as the processor 22, user interface 28 or the like, of another example embodiment is configured to cause the audio cue to be provided to the user by causing an artificially created sound representative of the object to be provided to the user. In this example embodiment, the artificially created sound is representative of the normalized distance to the object and, in turn, is representative of one or more parameters associated with the object. Thus, a user may not only determine the direction to the object based upon the artificially created sound, but may also obtain information regarding the one or more parameters associated with the object based on the perceived distance to the object which is representative of the one or more other parameters associated with the object. For example, the audio cue may cause an object having a greater parameter value to appear to be located further from the user and an object having a smaller parameter value to appear to be located closer to the user.

In an embodiment at which the predefined sound field region is a volume about the user of a predefined dimension, the apparatus 20, such as the processor 22, is configured to scale the distance to the object to create a normalized distance by scaling coordinates representative of the object so as to lie within the volume of the predefined dimension. For example, in an instance in which the volume is a sphere of a predefined radius, the apparatus, such as the processor, is configured to scale coordinates representative of the object by scaling spherical coordinates representative of the object so as to lie within the sphere of the predefined radius. By way of example, FIG. 4 depicts the spherical coordinates $(r_1, \theta_1, \varnothing_1)$ that identify the position of the object and which may be scaled, such as in a direct and proportionate manner, relative to the most remote object within an audio scene such that the scaled representations of the spherical coordinates representative of the object lie within the sphere of predefined radius.

The apparatus 20, such as the processor 22, of an example embodiment is configured to cause at least one audio cue to be provided to the user by processing audio signals with a head-related transfer function filter to create an audio cue such that the resulting audio cue(s) cause the object to appear to be located in the direction and at the normalized distance from the user. The head-related transfer function filter may be stored, such as by the processor, the memory 24 or the like, and may be any of a wide variety of different functions that is dependent upon both the normalized distance to an object and the direction to the object. By processing the audio signals with a head-related transfer function filter, audio signals, such as audio signals received from the sound source or artificially created sound, are convolved with the head-related transfer function filter that is dependent on the normalized distance to the object and the direction to the object to create the audio cue(s).

In order to more accurately determine the direction from the user to the object so as to permit the head-related transfer function filter to create a more representative audio cue, the apparatus 20, such as the processor 22, of an example embodiment is configured to determine the head bearing of the user. In this regard, the apparatus, such as the processor, is configured to receive information from which the head bearing of the user is determinable. For example, the user may carry or otherwise be associated with a head tracker that includes, for example, an inertial measurement unit that provides information regarding the angle of the user's head. The apparatus, such as the processor, of this example embodiment is therefore configured to take into account the head bearing of the user in the determination of the direction to the object, such that the head-related transfer function filter is configured to determine the audio cue based, in part upon the direction to the object after having accounted for the head bearing of the user.

By way of example, FIG. 5*a* depicts a user and plurality of points about the user at which the apparatus, such as the processor, of an example embodiment is configured to determine the amplitude of the audio cue(s) based upon a head-related transfer function filter. The head-related transfer function filter may differently define the amplitude in the near-field relative to the far-field and may define the amplitude in a manner that is dependent upon the angle relative to the user, such as with nose of the user pointing to 0°, and also dependent upon the frequency of the audio signals. In this regard, the amplitude at different angles relative to the user at a distance of 20 centimeters from the user (as indicated by the ring 36 of points about the user in FIG. 5*a*) is shown at different frequencies in FIG. 5*b*. Further, the relationship of the near-field to the far-field as determined by head-related transfer function at different angles and at different frequencies is shown in FIG. 5*c*. Regardless of the type of head-related transfer function filter, the apparatus, such as the processor, of an example embodiment is configured to utilize a head-related transfer function filter to process the audio signals such that a resulting audio cue is dependent upon both the normalized distance and the direction to the object.

In an example embodiment depicted in FIG. 6 in which the object is a sound source that generates audio signals, such as the climbers of FIG. 1, the apparatus 20 of an example embodiment is configured to communicate with one or more other computing devices, such as other mobile terminals, headsets 12, etc. In this regard, the communication interface 26 may include a communication unit 44 to communicate with other computing devices 48. The apparatus, such as the processor, of this example embodiment is also configured to receive information, such as from a location unit 46, such as a GPS, that defines the location of the user. The apparatus of this example embodiment is also configured to receive audio signals, such as audio signals received by one or more microphones 40 and then compressed as indicated at 42. The apparatus, such as the processor, is configured to determine the location from which the audio signals originate as indicated at 52. In addition, the apparatus, such as the processor, may be configured to receive information, such as from a head tracker 50 that includes, for example, an inertial measurement unit, regarding the head angle such that the head bearing is determinable.

Upon receipt of audio signals, the apparatus 20, such as the processor 22, of this example embodiment determines the distance to the object and the direction to the object, such as based upon the location of the user, the head bearing of the user, the location of the object and the like. See block 54. In some embodiments, the apparatus, such as the processor, provides for latency compensation by approximating the velocity of the head movement while taking into account the current head position including head angle, to predict the position of the head at the time at which the audio cue(s) will be provided to the user. See block 56. The apparatus, such as the processor 22, then scales the distance to the object to create a normalized distance, such as by scaling spherical coordinates representative of the location of the object with respect to the user so as to lie within a sphere of a predefined radius. See block 58. The apparatus, such as the processor, of this example embodiment then causes at least one audio cue representative of the object to be provided to the user. For example, the apparatus, such as the processor, may process the audio cue(s) with a head-related transfer function filter 60 based upon the scaled spherical coordinates representative of the object such that the resulting audio cue(s) causes the object to appear to be located at the normalized distance from the user and in the direction of the object upon rendering of the audio scene at 62, such as via headset loudspeakers 62.

In an alternative embodiment depicted in FIG. 7, the object does not generate audio signals, but is associated with one or more parameters that may be represented by an audio cue as a distance to the object. For example, the object may be any of various locations upon the earth's surface, the seafloor or the like with the parameter associated with the object being a height or altitude value associated with the respective location. In this example embodiment, in order to provide the pilot of an aircraft or the captain of ship or other marine vessel with information regarding the elevation of the various locations, elevation data may be stored, such as by memory 24, or otherwise received, such as via the communication interface 26. In the example embodiment of FIG. 7, the elevation data is provided at 66 and the position of the various locations may be determined by the processor 22 as shown at 52. In addition, the head bearing of the user, such as determined by head tracker 50, such as an inertial measurement unit, may be provided to the apparatus, such as the processor, such that the processor is able to determine the user's head position and direction as shown at 54. By determining the head position and direction, the audio cue(s) may be rendered in a consistent direction, even if the listener is moving his/her head. For example, if the audio signals are to come from the side, but the head is turned to that side, the head-related transfer function filter that is utilized will have a frontal bearing.

In this example embodiment, the apparatus 20, such as the processor 22, is configured to determine the distance to the object, such as a respective location on the earth's surface or the seafloor. In this regard, the distance is determined based upon the parameter value associated with the object, such as the elevation at the respective location on the earth's surface or the seafloor, such as by translating or mapping the elevation to a corresponding distance value. Additionally, the apparatus, such as the processor, of an example embodiment provides for latency compensation by approximating the velocity of the head movement while taking into account the current head position including head angle, to predict the position of the head at the time at which the audio cue(s) will be provided to the user. See block 56. As shown at 58, the apparatus, such as the processor, of this example embodiment then scales the distance to the object (which represents the elevation of a respective location) to create a normalized distance within a predefined sound field region about the user, while maintaining relative differences in the distances from objects to the user. For an airline pilot, the locations having the greatest height may be represented by a normalized distance that is the smallest so as to appear to be closest to the user, while the locations having lower or smaller heights may be represented by normalized distances that appear to be further from the user. By causing an audio cue of the object to be provided by an artificial sound source 68, such as in the form of a sonar-type ping, to the user, such as by use of a head-related transfer function filter 60, such as by rendering the audio scene as shown at 62 via headset loudspeakers 64, the audio cue causes the object to appear to be located at a normalized distance from the user with the distance representing, in this example embodiment, the elevation of a respective location. Thus, a pilot may view the surroundings through their windscreen while listening to an audio scene that reflects the elevation of the underlying terrain or, at least the elevation of certain points of interest within the underlying terrain with the elevation being represented by the normalized distance at which the sound sources appear to be located. Thus, an aircraft pilot may obtain greater information regarding their surroundings in an intuitive manner.

With reference to FIG. 8, another example is provided in which artificially created sound representative of a parameter value provided by any one or more of various metering gauges, such as a speedometer, a fuel gauge, a revolutions per minute (RPM) gauge or the like, is provided. In this example embodiment, the parameter measured by a respective metering gauge is received by the apparatus 20, such as the processor 22, as shown at 70 and a corresponding distance is determined as shown at 52. For example, the distance is representative of the parameter value and may, for example, vary in a direct and proportional manner to the parameter value. As each metering gauge is at a predefined position relative to the user, such as that a predefined position within an dashboard relative to the driver of a vehicle, the apparatus, such as the processor, of this example embodiment need not track the position of the user's head and, instead, the direction to each of the metering gauges may be predefined.

As in the other example embodiments, the apparatus 20, such as the processor 22, is configured to scale the distance to the object, that is, to scale the distance that is representative of a parameter measured by metering gauge, to create a normalized distance within a predefined sound field region about the user, as shown at 58. Thus, based upon the possible ranges of parameter values measured by the metering gauge, the distance that represents the parameter value may be scaled to a normalized distance. The apparatus, such as the processor, is then configured to cause an audio cue representative of metering gauge to be provided to the user with the audio cue causing the metering gauge to appear to be located at the normalized distance and in the predefined direction from the user with the distance being representative of the parameter measured by the metering gauge. As described above, the audio cue may be generated by an artificial sound source 68 in response to the output from a head-related transfer function filter 60 such that the audio cue causes the metering gauge to appear to be located at the normalized distance from the user. By way of example in which the metering gauge is a speedometer, the audio cue may cause the metering gauge to appear to be located at a normalized distance that is much closer to the user in an instance in which the vehicle is traveling at a greater rate of speed and to appear to be located at a normalized distance that is much further from the user in an instance in which the vehicle is traveling at a much slower speed. As such, the driver of the vehicle may obtain additional information in an intuitive manner regarding the various parameters measured by the metering gauges without having to look at the metering gauges and may, instead, continue to view their surroundings through the windshield so as to be more aware of their current situation.

Although described above in conjunction with the elevations of various locations and the parameters measured by various metering gauges, the method, apparatus 20 and computer program product of other example embodiments may generate artificially created sound that causes an object to appear to be located at a normalized distance in a certain direction from a user so as to provide information regarding a wide variety of other parameters associated with other types of objects. For example, in robot-aided/robotic surgery in which a doctor views an image obtained by one or more cameras, the doctor may continue to focus upon the image, but may be provided information regarding the distance to nearby veins or various organs based upon audio cues in which the veins or organs appear to be located at a normalized distance and in a certain direction for the surgery site. Additionally, in a game involving multiple players, the distance and direction to the other players may be represented by audio cues provided to a player with the audio cue causing the other players to appear to be located at normalized distances and in certain directions. The directional and distance information can be provided even in instances in which the other players cannot be physically seen, such as being on the other side of walls or otherwise being hidden.

As another example in which an audio scene represents the surrounding traffic, the method, apparatus 20 and computer program product of an example embodiment provide audio cues at a normalized distance and from a direction of other vehicles or various hazards that defines the traffic in the vicinity of a user. Still further, the method, apparatus and computer program product of another example embodiment provide audio cues that appear to originate at a normalized distance and from a particular direction so as to provide information to a technician regarding a machining operation, such as the depth to which the technician has drilled.

In yet another example embodiment, the apparatus 20 is configured to render sound in interactive video content such that the sound follows the viewing position. In this example embodiment in which the audio track of a video has been recorded with multiple microphones, the apparatus, such as the processor 22, is configured to process the audio signals when the video is zoomed in or out, when the video is panned or when the vantage point in the video is changed such that audio signals are represented in the same direction and at the same distance as the video.

By way of example, the audio signals may be captured using spatial audio capture (SPAC) such that the directions from which the audio signals originated are also recorded. The apparatus 20, such as the processor 22, of this example embodiment is configured to triangulate from the audio signals from at least three microphones to determine the distance to a respective waveform, such as the dominant or next to dominant waveform. In this regard, the processor may be configured to utilize a source separation method, such as independent component analysis (ICA), to separate the dominant waveform from the other waveforms. Utilizing the distance that has been determined to a respective waveform, the apparatus, such as the processor, scales the distance to a normalized distance and then modifies the audio signals to create an audio cue that is be rendered in a manner that places the sound source artificially close to the user such that the psychoacoustic ability of the user is able to better distinguish between sound sources at different distances. The foregoing process may be applied to either previously recorded audio signals or audio signals captured in real time.

As described above, FIG. 3 illustrates a flowchart of an apparatus 30, method and computer program product according to example embodiments of the invention. It will be understood that each block of the flowchart, and combinations of blocks in the flowchart, may be implemented by various means, such as hardware, firmware, processor, circuitry, and/or other communication devices associated with execution of software including one or more computer program instructions. For example, one or more of the procedures described above may be embodied by computer program instructions. In this regard, the computer program instructions which embody the procedures described above may be stored by a memory device 24 of an apparatus employing an embodiment of the present invention and executed by a processor 22 of the apparatus. As will be appreciated, any such computer program instructions may be loaded onto a computer or other programmable apparatus (for example, hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowchart support combinations of means for performing the specified functions and combinations of operations for performing the specified functions for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included, some of which have been described above and are illustrated by a dashed outline. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method comprising:

receiving signals relating to an object;

determining a distance from a user to the object and a direction from the user to the object;

scaling the distance to the object to create a modified distance within a predefined sound field region about the user; and causing at least one audio cue relating to the object to be audibly provided to the user such that the object appears to be located within the predefined sound field region in the direction and at the modified distance from the user, wherein causing at least one audio cue to be audibly provided to the user comprises causing a representation of the signals that were received relating to the object to be audibly provided to the user such that the signals appear to originate at the modified distance and from the direction of the object.

2. A method according to claim 1 wherein the object comprises a sound source, wherein receiving signals comprises receiving audio signals from the sound source, and wherein causing a representation of the signals that were received relating to the object to be audibly provided to the user comprises causing a representation of the audio signals from the sound source to be audibly provided to the user such that the audio signals appear to originate at the modified distance and from the direction of the sound source.

3. A method according to claim 1 wherein causing a representation of the signals that were received relating to the object to be audibly provided to the user comprises causing an artificially created sound representative of a parameter of the object to be audibly provided to the user.

4. A method according to claim 1 wherein causing at least one audio cue to be audibly provided to the user comprises processing audio signals with a head related transfer function filter that is dependent upon both the modified distance and the direction from the user to the object to create the at least one audio cue.

5. A method according to claim 4 further comprising determining a position and a head bearing of the user and identifying the head related transfer function filter based upon the position and head bearing of the user, wherein determining a distance and a direction from a user to an object comprises determining the distance and the direction from the user to the object based upon the position and head bearing of the user.

6. A method according to claim 1 wherein the predefined sound field region comprises a volume about the user of a predefined dimension, and wherein scaling the distance to the object to create a modified distance comprises scaling coordinates representative of the object so as to lie within the volume of the predefined dimension.

7. A method according to claim 6 wherein the volume comprises a sphere of a predefined radius, and wherein scaling coordinates representative of the object comprises scaling spherical coordinates representative of the object so as to lie within the sphere of the predefined radius.

8. An apparatus comprising at least one processor and at least one memory including computer program code, the at least one memory and computer program code configured to, with the processor, cause the apparatus to at least:

receive signals relating to an object;

determine a distance from a user to the object and a direction from the user to the object;

scale the distance to the object to create a modified distance within a predefined sound field region about the user; and cause at least one audio cue relating to the object to be audibly provided to the user such that the object appears to be located within the predefined sound field region in the direction and at the modified distance from the user, wherein the apparatus causes the at least one audio cue to be audibly provided to the user by causing a representation of the signals that were received relating to the object to be audibly provided to the user such that the signals appear to originate at the modified distance and from the direction of the object.

9. An apparatus according to claim 8 wherein the object comprises a sound source, wherein the at least one memory and computer program code are configured to, with the processor, cause the apparatus to receive signals by receiving audio signals from the sound source, and wherein the at least one memory and computer program code are configured to, with the processor, cause the apparatus to cause a representation of the signals that were received relating to the object to be audibly provided to the user by causing a representation of the audio signals from the sound source to be audibly provided such that the audio signals appear to originate at the modified distance and from the direction of the sound source.

10. An apparatus according to claim 8 wherein the at least one memory and computer program code are configured to, with the processor, cause the apparatus to cause a representation of the signals that were received relating to the object to be audibly provided to the user by causing an artificially created sound representative of a parameter of the object to be audibly provided to the user.

11. An apparatus according to claim 8 wherein the at least one memory and computer program code are configured to, with the processor, cause the apparatus to cause at least one audio cue to be audibly provided to the user by processing the at least one audio cue with a head related transfer function filter that is dependent upon both the modified distance and the direction from the user to the object to create the at least one audio cue.

12. An apparatus according to claim 11 wherein the at least one memory and computer program code are further configured to, with the processor, cause the apparatus to determine a position and a head bearing of the user and identify the head related transfer function filter based upon the position and head bearing of the user, wherein the at least one memory and computer program code are configured to, with the processor, cause the apparatus to determine a distance and a direction from a user to an object by determining the distance and the direction from the user to the object based upon the position and head bearing of the user.

13. An apparatus according to claim 8 wherein the predefined sound field region comprises a volume about the user of a predefined dimension, and wherein the at least one memory and computer program code are configured to, with the processor, cause the apparatus to scale the distance to the object to create a modified distance by scaling coordinates representative of the object so as to lie within the volume of the predefined dimension.

14. An apparatus according to claim 13 wherein the volume comprises a sphere of a predefined radius, and wherein the at least one memory and computer program code are configured to, with the processor, cause the apparatus to scale coordinates to the object by scaling spherical coordinates representative of the object so as to lie within the sphere of the predefined radius.

15. A computer program product comprising at least one non-transitory computer-readable storage medium having computer-executable program code portions stored therein, the computer-executable program code portions comprising program code instructions configured to:

receive signals relating to an object;

determine a distance from a user to the object and a direction from the user to the object;

scale the distance to the object to create a modified distance within a predefined sound field region about the user; and cause at least one audio cue relating to the object to be audibly provided to the user such that the object appears to be located within the predefined sound field region in the direction and at the modified distance from the user, wherein the program code instructions configured to cause at least one audio cue to be audibly provided to the user comprise program code instructions configured to cause a representation of the signals that were received relating to the object to be audibly provided to the user such that the signals appear to originate at the modified distance and from the direction of the object.

16. A computer program product according to claim 15 wherein the object comprises a sound source, wherein the program code instructions configured to receive signals comprise program code instructions configured to receive audio signals from the sound source, and wherein the program code instructions configured to cause a representation of the signals that were received relating to the object to be audibly provided to the user comprise program code instructions configured to cause a representation of the audio signals from the sound source to be audibly provided to the user such that the audio signals appear to originate at the modified distance and from the direction of the sound source.

17. A computer program product according to claim 15 wherein the program code instructions configured to cause a representation of the signals that were received relating to the object to be audibly provided comprise program code instructions configured to cause an artificially created sound representative of a parameter of the object to be audibly provided to the user.

18. A computer program product according to claim 15 wherein the program code instructions configured to cause at least one audio cue to be audibly provided to the user comprise program code instructions configured to process the at least one audio cue with a head related transfer function filter that is dependent upon both the modified distance and the direction from the user to the object to create the at least one audio cue.

19. A computer program product according to claim 18 wherein the computer-executable program code portions further comprise program code instructions configured to determine a position and a head bearing of the user and identify the head related transfer function filter based upon the position and head bearing of the user, wherein program code instructions configured to determine a distance and a direction from a user to an object comprise program code instructions configured to determine the distance and the direction from the user to the object based upon the position and head bearing of the user.

20. A computer program product according to claim 15 wherein the predefined sound field region comprises a volume about the user of a predefined dimension, and wherein the program code instructions configured to scale the distance to the object to a normalized distance comprise program code instructions configured to scale coordinates representative of the object so as to lie within the volume of the predefined dimension.

* * * * *